US005798051A

United States Patent [19]

Hill

[11] Patent Number: 5,798,051

[45] Date of Patent: Aug. 25, 1998

[54] SEALING DEVICE FOR MOLTEN METAL VALVE PIN

[75] Inventor: Gary C. Hill, La Salle, Canada

[73] Assignee: Build A Mold, Ltd., Windsor, Canada

[21] Appl. No.: 622,868

[22] Filed: Mar. 29, 1996

[51] Int. Cl.[6] ..... B22D 41/08

[52] U.S. Cl. ..... 222/590; 222/591; 222/598; 277/207 A

[58] Field of Search ..... 277/207 A, 236; 222/590, 591, 598, 597; 164/34, 36, 35

[56] References Cited

U.S. PATENT DOCUMENTS

| | | | |
|---|---|---|---|
| 4,617,982 | 10/1986 | Tanimura et al. | 164/463 |
| 4,635,896 | 1/1987 | Baker | 277/236 |
| 5,044,419 | 9/1991 | Ware | 164/34 |
| 5,085,344 | 2/1992 | Hintzen | 222/590 |
| 5,106,106 | 4/1992 | Bruckner et al. | 222/598 |
| 5,230,813 | 7/1993 | Hintzen | 222/598 |

*Primary Examiner*—Scott Kastler
*Attorney, Agent, or Firm*—Howard & Howard

[57] ABSTRACT

A sealing arrangement for the molten metal portion of a lost core molding assembly includes a cooling chamber placed adjacent an opening of a heated nozzle chamber. The cooling chamber includes a generally cylindrical passageway that is aligned with the opening in the heated chamber distant from a tip of the nozzle. The generally cylindrical passage includes a reservoir, of a preselected axial length, for collecting a portion of the molten material that is allowed to enter into the passage. The collected material is cooled and solidified within the reservoir in order to form a generally annular bushing around a moving member that moves through the passage and the opening in the heated chamber while still permitting the moving member to move in a controlled manner. The annular bushing that is formed is self-repairing as additional molten material contacts the bushing and solidifies as part of the bushing.

24 Claims, 2 Drawing Sheets

50
54
24
28
38
46
44
46
35
COOLANT

SEALING DEVICE FOR MOLTEN METAL VALVE PIN

BACKGROUND OF THE INVENTION

This invention relates generally to lost core molding machines and, more specifically, to a device and methodology for providing a seal for maintaining a molten material within a chamber in a controlled manner.

Conventional lost core molding processes require the use of a nozzle for injecting a molten material, such as molten metal, into a mold. The nozzle is coupled to a source of the molten metal and used to control the amount of molten material that is supplied into the mold. Conventional nozzles include a moving member or pin that closes off the tip of the nozzle to control the amount of molten material that flows out of the nozzle. In order to control the pin that closes off the nozzle, one end of the pin that is distal from the nozzle tip necessarily extends outside of the nozzle chamber. A conventional device, such as a hydraulic arrangement positioned outside of the nozzle chamber, moves the pin into and out of a position for closing off the tip of the nozzle.

At the location where the moving pin exits the nozzle chamber, it is necessary to provide a seal for maintaining the molten material within the nozzle chamber. In lost core molding applications that include molten metals, conventional seals have proven highly unsatisfactory. The molten metal is a highly abrasive fluid. In some applications, the molten metal that is used in the molding process causes a conventional seal to deteriorate over a short period of time. Further problems are typically experienced after the molten metal is allowed to cool. Any cooled metal that is present around a conventional seal expands upon cooling and, therefore, pries open a conventional seal, rendering the seal essentially useless during a subsequent molding process.

There is a need for a molten metal sealing arrangement in lost core molding applications that reliably maintains the molten metal within the nozzle chamber at the point where a moving pin exits the nozzle arrangement. This invention provides such a sealing arrangement.

SUMMARY OF THE INVENTION

In general terms, this invention is a system for controlling a flow of molten material, especially for use in a lost core molding process. The system includes a heated chamber for containing the molten material. The heated chamber has first and second openings. A moving valve pin has a portion that moves axially through the first opening of the heated chamber between a first position for allowing the molten material to exit the second opening and a second position wherein a distal end of the moving valve pin closes the second opening of the heated chamber. A cooling chamber is placed adjacent the heated chamber. The cooling chamber has a generally cylindrical passage that is axially aligned with the first opening in the heated chamber such that a portion of the moving member moves axially through the cooling chamber passage as it moves through the first opening of the heated chamber. The generally cylindrical passage of the cooling chamber includes a reservoir for collecting a portion of the molten material that enters into the passage. The reservoir has a preselected axial length. The cooling chamber cools and solidifies the portion of the material that is collected in the reservoir to thereby form a bushing that seals the passage closed while also permitting the moving member to continue moving axially through the first opening of the heated chamber.

In the preferred embodiment, the reservoir within the cooling chamber includes a plurality of annular grooves, each having a preselected axial length. The portion of the material that is collected and solidified in the axial grooves forms annular bushing seals of solidified material that are maintained in position within the passage of the cooling chamber while allowing the moving member to move through the first opening of the heated chamber.

The method of this invention for selectively maintaining a molten material within a chamber having a moving member that moves axially through a generally cylindrical opening in the chamber includes three basic steps. First, a portion of the molten material is allowed to enter part of the cylindrical opening in the chamber. A portion of the molten material that enters the cylindrical opening is collected within a reservoir in that opening before the material exits the opening such that the collected material surrounds the moving member. Lastly, the material collected in the reservoir is cooled and solidified to thereby seal the opening around the moving member while permitting the moving member to move through the sealed opening.

In the preferred embodiment, the collected molten material is cooled and solidified into a solid bushing ringseal. The most preferred method includes continuously repairing any defects that form in the bushing seal, which may include scoring that occurs because of the movement of the moving member, by allowing additional molten material to fill any defects in the bushing and to be cooled as part of the repaired solid ring.

In another feature of this invention, a forward end of the moving pin has vent grooves. The vent grooves assist the moving pin in displacing molten material as it approaches its valve seat.

These and other features and advantages of this invention will become apparent to those skilled in the art from the following detailed description of the preferred embodiment. The drawings that accompany the detailed description can be briefly described as follows.

DETAILED DESCRIPTION OF THE PREFERRED EMBODIMENT

Figure 1:
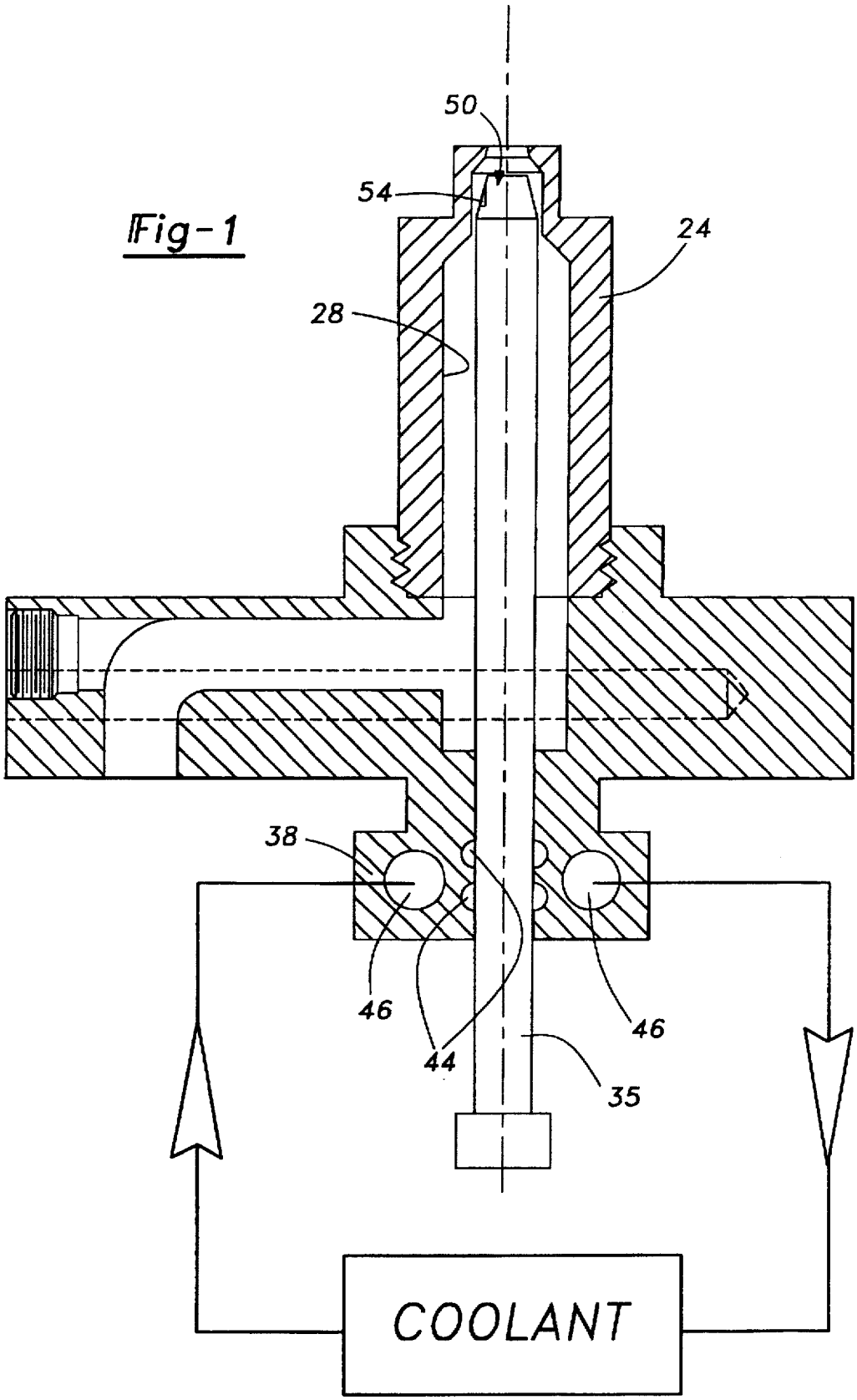
FIG. 1 is a schematic, diagrammatic view of a lost core molding assembly including a sealing device designed according to this invention.

FIG. 1 diagrammatically and schematically illustrates a lost core molding assembly 20. As is known, lost core molding systems cast metal plugs that are then moved to an injection mold where plastic is injected around the metal plug. This invention is directed to improving the handling of the molten metal.

A heated chamber 22 includes a nozzle 24 and a chamber body 26. The means for heating the chamber are not illustrated and may be conventional. The nozzle 24 and chamber body 26 include a flow passage 28 that allows a molten material, such as molten metal, to be provided from a source or vessel 30 through the nozzle 24. The heated chamber 22 includes a first opening 32 and a second opening 34. The molten material preferably is allowed to flow out of the second opening 34 but should not exit the first opening 32. A moving pin 35 is provided for controlling the amount of molten material that exits the opening 34 into a mold 36

(shown schematically). The moving pin 35 moves between a first position where the molten material is allowed to flow into the mold 36 and a second position where the opening 34 is closed by the moving pin 35. A conventional hydraulic arrangement (not illustrated), which is positioned outside of the heated chamber 22, moves the moving member or pin 35 in a controlled manner.

A cooling chamber 38 is provided adjacent the heated chamber 22. The cooling chamber 38 preferably includes a generally cylindrical passage 40 that is axially aligned with the first opening 32 of the heated chamber body 26. A portion of the moving member 35 moves axially through the generally cylindrical passage 40.

A sealing arrangement is provided in the passage 40, which prevents molten metal from undesirably exiting the opening 32. The sealing arrangement includes a reservoir 42 that preferably includes a plurality of annular grooves 44, which can be axially adjacent each other or axially spaced along the cylindrical passage 40. A cooling fluid channel 46 is provided in the body of the cooling chamber 38. A conventional source of cooling fluid 48 supplies cooling fluid through the channel 46 to maintain the temperature of the cooling chamber 38 well below the melting temperature of the molten material within the heated chamber 22. The cooling fluid passage 46 preferably is a generally annular ring through the body of the cooling chamber 38 that generally surrounds the annular grooves 44. As schematically illustrated, the cooling fluid passage 46 is preferably generally axially aligned with the reservoir 42.

Figure 2:
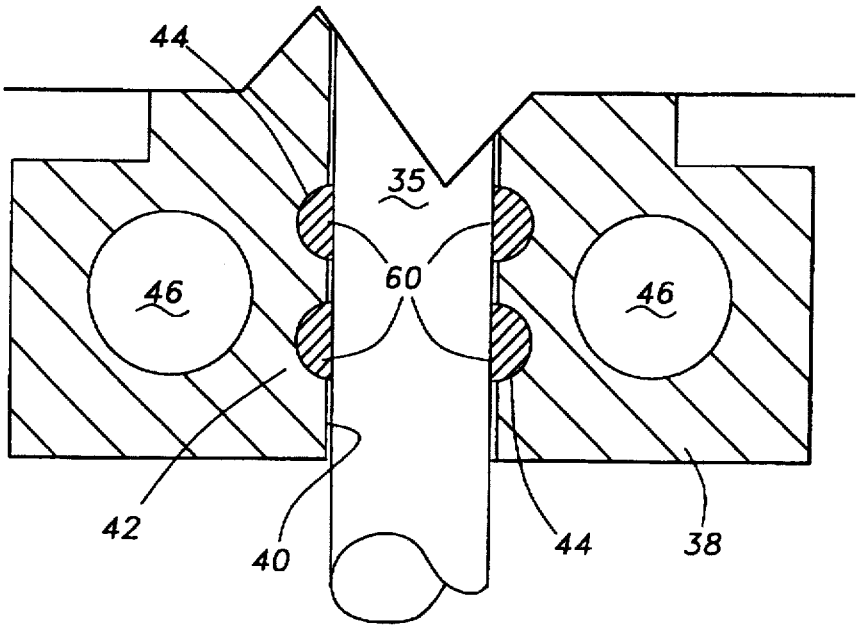
FIG. 2 is a fragmentary schematic illustration of selected portions of the embodiment of FIG. 1.

FIG. 2 schematically illustrates an annular bushing or seal 60 that is formed according to this invention. A portion of the molten material is allowed to move through the opening 32 into the passage 40. That material is collected within the reservoir 42 (i.e., the annular grooves 44) and cooled by the cooling chamber 38. The collected material therefore solidifies into generally annular rings 60, which provide a bushing effectively sealing off the opening 32 of the heated chamber 22.

The axial length of the sealing bushings or rings 60 preferably is kept within a desired range to seal off the end of the heated chamber 22 while still permitting the moving member 35 to be moved in a manner that controls the opening 34 of the nozzle 24. To further ensure that the pin 35 is permitted to move, the reservoir 42 preferably is located relatively axially near the opening 32 to avoid an undesirable build-up of solidified material along a substantial portion of the passage 40. The moving member 35 preferably is coated with a ceramic material that does not adhesively bond to the molten material used in the lost core molding process.

The molten metals used in lost core molding are well known by those skilled in the art. Essentially, they are selected for relatively low melt temperatures. In one embodiment, where a tin and bismuth molten metal is utilized, the fluid used within the channel 46 preferably includes water having a temperature in the range between about 55° and approximately 85° F. This temperature range is sufficient to cool and solidify the molten metal such that it expands and forms the annular sealing bushings 60.

A significant advantage to a sealing arrangement as provided by this invention is that the seal is self-repairing and self-sealing. In the event that a sealing ring 60 is scored or otherwise damaged during repeated use, additional molten metal that moves into the passage 40 will be cooled and solidified into the portion of the ring 60 that was previously damaged. Accordingly, an essentially permanent bushing or seal is maintained that is self-repairing over time.

Figure 3:
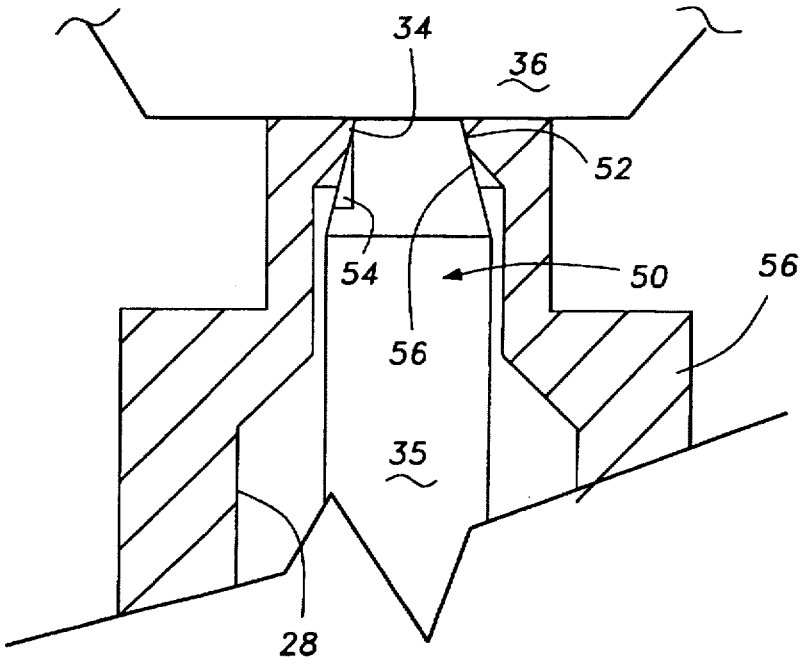
FIG. 3 is a fragmentary schematic illustration of selected portions of the embodiment of FIG. 1.

FIG. 3 schematically illustrates the presently preferred embodiment of the distal seating end 50 of the moving pin 35. The end 50 of the pin 35 is used to seat on the nozzle valve seat and close off the opening 34 in the nozzle 24 in a controlled fashion. In conventional systems, it is typical to have an uncontrolled amount of molten metal that is either trapped between the pin 35 and the portion of the nozzle 24 surrounding the opening 34 or to allow some of that molten metal to escape while the pin 35 is moving into the closed position. The pin 35, designed according to this invention, avoids such difficulties.

The end 50 preferably includes a generally truncated conical peripheral surface 52 adjacent the terminal or seating end of the moving pin 35. A plurality of vent channels 54 preferably are provided by axially extending groves about the periphery of the moving member 35. The vent channels 54 preferably extend from a point near the terminal end of the moving pin 35 to a second point that is more axially inward toward the axial center of the pin 35 (i.e., between peripheral surface 52 and a more central point on pin 35). The vent channels 54 allow any molten material near the opening 34 to be vented back down into the channel 28 as the pin 35 moves into the closed position. The generally truncated conical peripheral surface 52 sealingly abuts a mating surface 56 on the nozzle 24 to close off the heated chamber 22.

A worker in this art will appreciate that variations and modifications of the disclosed, preferred embodiment are possible. For that reason, the following claims should be studied to determine the true scope of this invention.

What is claimed is:

1. A method of selectively maintaining a molten material within a chamber having a moving member that moves axially through an opening in the chamber, comprising the steps of:

(A) allowing a portion of the molten material to enter part of the opening;

(B) collecting the portion of the molten material from step (A) within the opening before the material exits the opening such that the collected material surrounds the moving member; and (C) solidifying the material collected in step (B) to thereby provide a bushing at the opening around the moving member while permitting the moving member to move through the bushing and the opening.

2. The method of claim 1, wherein step (A) is performed by permitting the portion of the molten material to flow alongside the moving member and partially into the opening.

3. The method of claim 1, wherein step (B) is performed by collecting the portion of the molten material in a reservoir within the opening.

4. The method of claim 3, wherein step (C) is performed by cooling the material collected in the reservoir.

5. The method of claim 4, wherein step (C) is performed by the substep of cooling the reservoir.

6. The method of claim 1, wherein step (C) is performed by the substeps of cooling the material collected in step (B) by cooling at least a portion of the opening, using a cooling fluid outside of the opening, and wherein the cooling fluid has a temperature that is sufficiently low to maintain a temperature of the material in the opening below the melting temperature of the material.

7. The method of claim 6, further comprising heating a portion of the chamber spaced from the opening.

8. The method of claim 1, wherein steps (B) and (C) are performed simultaneously.

9. The method of claim 1, wherein step (C) is performed by forming an annular bushing around the moving member within the opening and further comprising allowing additional molten material to contact the annular bushing and cooling the additional material to thereby seal off defects formed in the annular bushing.

10. A device for sealing an opening in a heated chamber for containing a molten material, wherein a moving member moves axially through the opening, comprising:

a cooling chamber having a body with a generally cylindrical passage aligned with the opening in the heated chamber such that the moving member moves axially through the cooling chamber passage, said passage including an annular reservoir having a preselected axial length for collecting a portion of molten material that enters said passage, said cooling chamber also including a cooling fluid channel through a portion of said body near said passage for conducting cooling fluid through said portion of said body to thereby cool said reservoir and to solidify the portion of the material collected in said reservoir.

11. The device of claim 10, wherein said reservoir comprises an annular groove along said generally cylindrical passage.

12. The device of claim 10, wherein said reservoir comprises a plurality of axially spaced annular grooves in said generally cylindrical passage.

13. The device of claim 10, wherein said cooling fluid channel comprises a hollow, generally annular ring within said body that has an inside diameter that is greater than an outside diameter on said reservoir and wherein said cooling passage is generally axially aligned with said reservoir.

14. A system for controlling a flow of a molten material, comprising:

a first chamber for containing the molten material that has first and second openings;

a moving member having a portion that moves axially through said first opening in said first chamber between a first position for allowing the molten material to exit said second opening and a second position wherein a distal end of said moving member closes said second opening in said heated chamber;

a cooling chamber adjacent said first chamber and having a passage aligned with said first opening in said first chamber such that said portion of said moving member moves axially through said passage, said passage including a reservoir having a preselected axial length for collecting a portion of the molten material that enters said passage, said cooling chamber cooling and solidifying the portion of the material collected in said reservoir to thereby seal said passage while permitting said moving member to move between said first and second positions.

15. The system of claim 14, wherein said first chamber comprises heating means.

16. The system of claim 14, wherein said passage is cylindrical.

17. The system of claim 16, wherein said reservoir comprises an annular groove within said passage.

18. The system of claim 17, wherein the portion of the material that is collected and solidified in said reservoir forms an annular bushing of solidified material that is maintained in an axial position within said groove.

19. The system of claim 14, wherein said reservoir comprises a plurality of annular grooves along said passage.

20. The system of claim 14, wherein said distal end of said moving member includes at least one vent channel on an outer surface of said moving member, said vent channel extending from a first point near a terminal end on said distal end to a second point spaced axially inward from said first point.

21. The system of claim 20, wherein said distal end of said moving member terminates in a generally truncated conical continuous outer peripheral surface that is adapted to sealingly engage a mating surface on said first chamber.

22. The system of claim 14, wherein said moving member has an outer covering of a second material that will not adhesively bond to the molten material.

23. The system of claim 14, wherein said cooling chamber includes a cooling fluid channel near said reservoir and wherein a cooling fluid is passed through said channel to thereby cool said reservoir and the material that is collected in said reservoir.

24. The device of claim 23, wherein said cooling fluid channel comprises a generally annular ring within said cooling chamber that has an inside diameter that is greater than an outside diameter on said reservoir and wherein said cooling passage is generally axially aligned with said reservoir.

* * * * *